US006001047A

United States Patent [19]

Ferrara

[11] Patent Number: 6,001,047

[45] Date of Patent: Dec. 14, 1999

[54] SAFE BABY WALKER

[76] Inventor: Giovanna Ferrara, 1339 Pleasant St., Brockton, Mass. 02401

[21] Appl. No.: 09/036,432

[22] Filed: Mar. 5, 1998

[51] Int. Cl.[6] ..... A47D 13/04

[52] U.S. Cl. ..... 482/66; 297/5; 280/87.051

[58] Field of Search ..... 482/51, 66–69; 434/255; 472/15, 14; 297/5, 344.24, 136–138; 280/87.051

[56] References Cited

U.S. PATENT DOCUMENTS

| | | | |
|---|---|---|---|
| 150,398 | 5/1874 | Clonen et al. | 482/51 |
| 761,514 | 5/1904 | Leininger | 482/51 |
| 839,681 | 12/1906 | Voigt, Sr. | 482/66 |
| 841,700 | 1/1907 | Linden | 482/66 |
| 875,377 | 12/1907 | Pilia et al. | 482/51 |
| 1,154,543 | 9/1915 | Passerieux | 482/51 |
| 1,294,300 | 2/1919 | Noel, Sr. | 482/51 |
| 1,297,800 | 3/1919 | Cranford | 472/15 |
| 1,419,890 | 6/1922 | Noel, Sr. | 482/51 |
| 2,766,464 | 10/1956 | Savi | 297/136 |
| 4,043,552 | 8/1977 | Kerkonian | 482/96 |
| 5,522,782 | 6/1996 | Kurtin et al. | 482/66 |

FOREIGN PATENT DOCUMENTS

| | | | |
|---|---|---|---|
| 536402 | 5/1922 | France | 482/66 |
| 25682 | 5/1923 | France | 482/66 |
| 563936 | 12/1923 | France | 482/66 |
| 565454 | 1/1924 | France | 482/68 |
| 596738 | 10/1925 | France | 482/66 |
| 1018712 | 1/1953 | France | 482/66 |
| 661535 | 11/1951 | United Kingdom | 482/66 |

*Primary Examiner*—Jerome W. Donnelly
*Assistant Examiner*—Victor K. Hwang

[57] ABSTRACT

A stationary baby walker is provided including a stationary frame. A baby seat is movable along the frame and rotatable for allowing a baby to walk along a path, turn around, and again walk along the path.

6 Claims, 2 Drawing Sheets

FIG. 3
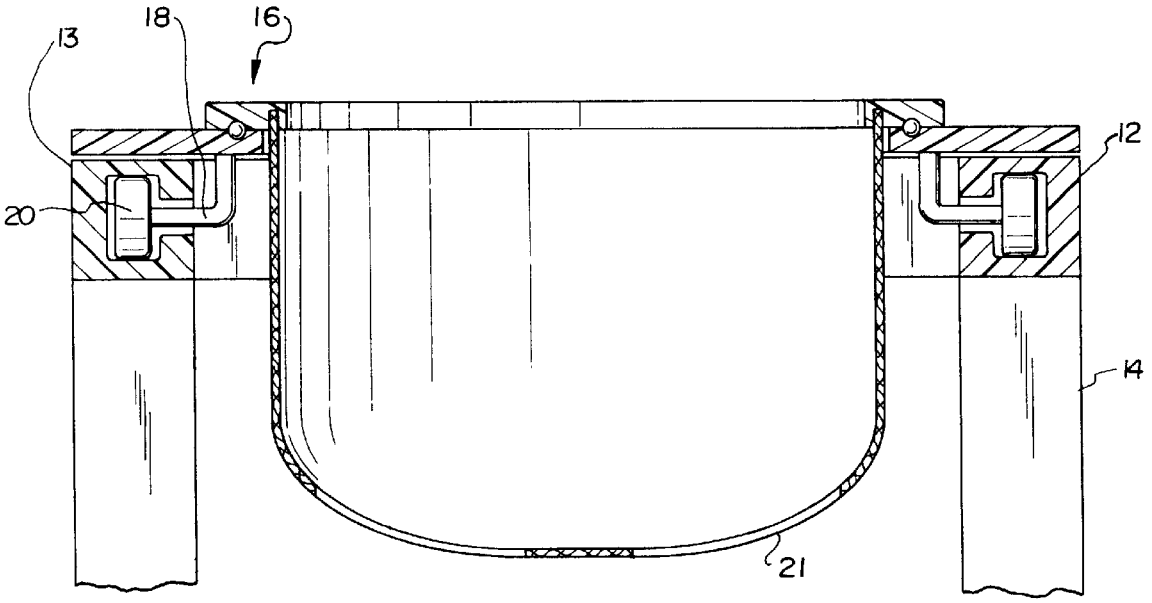
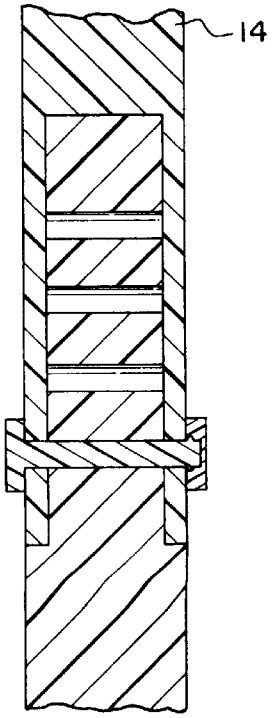
FIG. 4

SAFE BABY WALKER

BACKGROUND OF THE INVENTION

1. Field of the Invention

The present invention relates to baby walkers and more particularly pertains to a new safe baby walker for allowing a child to safely practice walking.

2. Description of the Prior Art

The use of baby walkers is known in the prior art. More specifically, baby walkers heretofore devised and utilized are known to consist basically of familiar, expected and obvious structural configurations, notwithstanding the myriad of designs encompassed by the crowded prior art which have been developed for the fulfillment of countless objectives and requirements.

Known prior art baby walkers include U.S. Pat. No. 4,795,151; U.S. Pat. No. 4,773,639; U.S. Pat. No. 5,409,246; U.S. Pat. No. 5,050,504; U.S. Pat. No. 5,433,682; and U.S. Pat. Des. 284,647.

In these respects, the safe baby walker according to the present invention substantially departs from the conventional concepts and designs of the prior art, and in so doing provides an apparatus primarily developed for the purpose of allowing a child to safely practice walking.

SUMMARY OF THE INVENTION

In view of the foregoing disadvantages inherent in the known types of baby walkers now present in the prior art, the present invention provides a new safe baby walker construction wherein the same can be utilized for allowing a child to safely practice walking.

The general purpose of the present invention, which will be described subsequently in greater detail, is to provide a new safe baby walker apparatus and method which has many of the advantages of the baby walkers mentioned heretofore and many novel features that result in a new safe baby walker which is not anticipated, rendered obvious, suggested, or even implied by any of the prior art baby walkers, either alone or in any combination thereof.

To attain this, the present invention generally comprises a stationary frame having a rectangular upper extent formed of a pair of parallel elongated side bars and a pair of short parallel end bars. As shown in FIG. 3, each of the bars of the upper extent has a square cross-section along an entire length thereof. As such, the bars of the upper extent define a vertical inner periphery. The elongated side bars of the upper extent each have a channel with a first predetermined height extending along a central axis thereof. A slot is formed between the vertical inner periphery and a central extent of the channel. With reference still to FIG. 3, it is shown that the slot has a height less than ½ that of the channel. The frame further includes four stanchions each having an upper end integrally coupled to ends of the elongated side bars of the upper extent. Such stanchions extend outwardly and downwardly therefrom in coplanar relationship with the other stanchion of the corresponding elongated side bar. For affording additional strength, a pair of supports are each coupled between central extents of two of the stanchions in parallel with the associated elongated side bar of the upper extent. Next provided is a baby seat support assembly including a planar square plate having a circular aperture formed therein. A pair of L-shaped arms are coupled to a lower surface of the square plate adjacent to each side edge thereof. Each arm has a horizontal extent with a roller rotatably mounted thereon. In operation, each roller is slidably situated within the channel of the corresponding elongated side bar of the upper extent of the frame. As such, the plate is capable of reciprocating atop the elongated side bars between the short end bars. Finally, a baby seat has a flexible cylindrical side wall and a flexible bottom wall having a pair of leg apertures formed therein. The baby seat defines an interior space and an upper peripheral edge. The baby seat further includes a rigid and annular upper peripheral lip coupled to the upper peripheral edge of the flexible cylindrical wall and extended radially therefrom. The upper peripheral lip is rotatably coupled to a top surface of the baby seat support assembly with the flexible side wall and bottom wall depending through the aperture of the plate of the baby seat support assembly. By this structure, a baby residing within the baby seat is permitted to both rotate about a vertical axis and move linearly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is therefore an object of the present invention to provide a new safe baby walker apparatus and method which has many of the advantages of the baby walkers mentioned heretofore and many novel features that result in a new safe baby walker which is not anticipated, rendered obvious, suggested, or even implied by any of the prior art baby walkers, either alone or in any combination thereof.

It is another object of the present invention to provide a new safe baby walker which may be easily and efficiently manufactured and marketed.

It is a further object of the present invention to provide a new safe baby walker which is of a durable and reliable construction.

An even further object of the present invention is to provide a new safe baby walker which is susceptible of a low cost of manufacture with regard to both materials and labor, and which accordingly is then susceptible of low prices of sale to the consuming public, thereby making such safe baby walker economically available to the buying public.

Still yet another object of the present invention is to provide a new safe baby walker which provides in the apparatuses and methods of the prior art some of the advantages thereof, while simultaneously overcoming some of the disadvantages normally associated therewith.

Still another object of the present invention is to provide a new safe baby walker for allowing a child to safely practice walking.

Even still another object of the present invention is to provide a new safe baby walker that includes a stationary frame. A baby seat is movable along the frame and rotatable for allowing a baby to walk along a path, turn around, and again walk along the path.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of the present invention taken along line 3—3 shown in FIG. 2.

FIG. 4 is a cross-sectional view of the present invention taken along line 4—4 shown in FIG. 1.

DESCRIPTION OF THE PREFERRED EMBODIMENT

Figure 1:
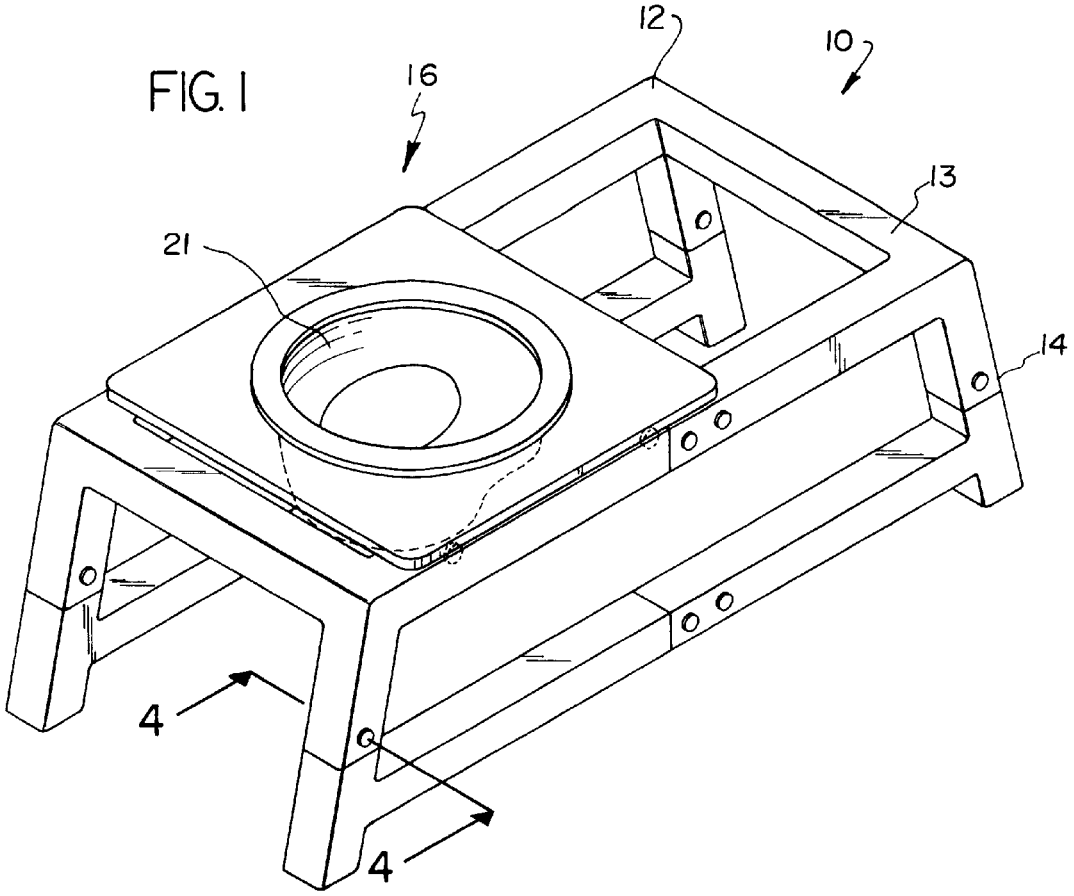
FIG. 1 is a perspective view of a new safe baby walker according to the present invention.
Figure 2:
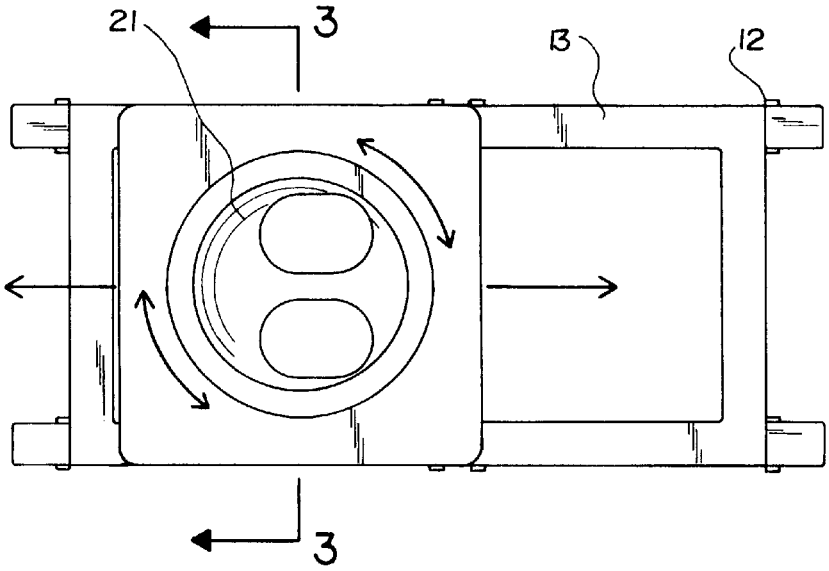
FIG. 2 is a top view of the present invention.

With reference now to the drawings, and in particular to FIGS. 1 through 4 thereof, a new safe baby walker embodying the principles and concepts of the present invention and generally designated by the reference numeral 10 will be described.

The present invention, designated as numeral 10, includes a stationary frame 12 having a rectangular upper extent 13 formed of a pair of parallel elongated side bars and a pair of parallel short end bars. As shown in FIG. 3, each of the bars of the upper extent has a square cross-section along an entire length thereof. As such, the bars of the upper extent define a vertical inner periphery. The elongated side bars of the upper extent each have a channel with a first predetermined height extending along a central axis thereof. A slot is formed between the vertical inner periphery and a central extent of the channel. With reference still to FIG. 3, it is shown that the slot has a height less than ½ that of the channel.

The frame further includes four stanchions 14 each having an upper end integrally coupled to ends of the elongated side bars of the upper extent. Such stanchions extend outwardly and downwardly from the upper extent in coplanar relationship with the other stanchion of the corresponding elongated side bar. For affording additional strength, a pair of supports are each coupled between central extents of two of the stanchions in parallel with the associated elongated side bar of the upper extent.

Preferably, the supports, elongated side bars, and stanchions are split at a central extent thereof. As shown in FIG. 4, at each split, a female end and a male end are provided for allowing the adjustment of a length of each of the aforementioned components. To selectively fix such length, a plurality of apertures are formed in both the male and female end. Associated therewith are a plurality of pins capable of being removably situated within such apertures when aligned. As such, both the length and height of the frame is adjustable. In the preferred embodiment, the frame is weighted for additional stability.

Next provided is a baby seat support assembly 16 including a planar square plate having a circular aperture formed therein. A pair of L-shaped arms 18 are coupled to a lower surface of the square plate adjacent to each side edge thereof. Each arm has a horizontal extent with a roller rotatably mounted thereon. In operation, each roller 20 is slidably situated within the channel of the corresponding elongated side bar of the upper extent of the frame. As such, the plate is capable of reciprocating atop the elongated side bars between the short end bars.

Finally, a baby seat 21 has a flexible cylindrical side wall and a flexible bottom wall having a pair of leg apertures formed therein. The baby seat defines an interior space and an upper peripheral edge. The baby seat further includes a rigid and annular upper peripheral lip coupled to the upper peripheral edge of the flexible cylindrical side wall and extended radially therefrom. The upper peripheral lip is rotatably coupled to a top surface of the baby seat support assembly with the flexible side wall and bottom wall depending through the aperture of the plate of the baby seat support assembly. Such rotatable coupling is ideally facilitated by way of a bearing assembly positioned between the baby seat and the support assembly. By this structure, a baby residing within the baby seat is permitted to both rotate 360 degrees about a vertical axis and move linearly along a straight path multiple times.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stationary baby walker comprising:

a stationary frame including a rectangular upper extent formed of a pair of parallel elongated side bars and a pair of short parallel end bars with each of the bars of the upper extent having a square cross-section along an entire length thereof such that the bars of the upper extent define a vertical inner periphery, the elongated side bars of the upper extent each having a channel with a first predetermined height extending along a central axis thereof and a slot formed between the vertical inner periphery and a central extent of the channel with the slot having a height less than ½ that of the channel the frame further including four stanchions each having an upper end integrally coupled to ends of the elongated side bars of the upper extent and extending outwardly and downwardly therefrom in coplanar relationship with the other stanchion of the corresponding elongated side bar and a pair of supports each coupled between central extents of two of the stanchions in parallel with the associated elongated side bar of the upper extent;

a baby seat support assembly including a planar square plate having a circular aperture formed therein and a pair of L-shaped arms coupled to a lower surface of the square plate adjacent to each side edge thereof, each arm having a horizontal extent with a roller rotatably mounted thereon, wherein each roller is slidably situated within the channel of the corresponding elongated side bar of the upper extent of the frame such that the plate is capable of reciprocating atop the elongated side bars between the short end bars; and a baby seat having a flexible cylindrical side wall and a flexible bottom wall having a pair of leg apertures formed therein wherein the baby seat defines an interior space and an upper peripheral edge, the baby seat further including a rigid and annular upper peripheral lip coupled to the upper peripheral edge of the flexible cylindrical wall and extending radially therefrom, whereby the upper peripheral lip is rotatably coupled to a top surface of the baby seat support assembly with the flexible side wall and bottom wall depending through the aperture of the plate of the baby seat support assembly thereby allowing a baby residing within the baby seat to both rotate about a vertical axis and move linearly;

wherein each of the stanchions comprises upper and lower segments, one of the segments of each of the stanchions being telescopically received in the other of the segments of the stanchion to permit selective lengthening and shortening of the length of the stanchion such that the height of the upper extent above a surface on which the stanchion rests may be adjusted to adapt to the leg length of the baby; and wherein the stationary frame is comprised of a pair of opposed frame sections, and wherein the upper extent of each frame section comprises a generally U-shaped structure oriented in opposition to the U-shaped structure of the other frame section wherein each U-shaped structure comprises one of said end bars and a portion of each side bar, wherein a central extent of the side bar portions of one of the U-shaped structures is adapted to be telescopically received in a central extent of the side bar portions of the other of the U-shaped structures to permit selective adjustment of the distance between the end bars of the upper extent such that the travel distance of the baby seat support assembly is selectively adjustable.

2. A stationary baby walker comprising:

a stationary frame including a rectangular upper frame portion formed of a pair of parallel side bars and a pair of parallel end bars, the side bars of the upper frame portion each having a hollow interior channel therein and a slot through a side wall of the side bar, the frame further including four substantially vertical stanchions, each stanchion having an upper end coupled to an end of one of the side bars of the upper frame portion;

a baby seat support assembly including a plate having a circular aperture formed therein, a pair of L-shaped arms coupled to a lower surface of the plate adjacent to each side edge of the plate, each arm having a horizontal extent with a roller rotatably mounted to an end of the arm located opposite the plate thereon, wherein each roller is rotatably situated in the hollow interior channel of one of the side bars of the upper frame portion such that the plate is capable of moving between the end bars of the upper frame portion;

a baby seat having a flexible substantially cylindrical side wall and a flexible bottom wall, the bottom wall having a pair of leg apertures formed therein, wherein the baby seat defines an interior space and has an upper peripheral edge mounted to a rigid and circular upper peripheral lip, the tipper peripheral lip being rotatably rested on a top surface of the plate with the flexible side wall and bottom wall depending through the aperture of the plate such that a baby seated in the baby seat is permitted to rotate the seat with respect to the plate and the stationary frame; and a support bar extending between central locations on the lower sections of adjacent stanchions in parallel with one of the side bars of the upper frame portion;

wherein each of the stanchions comprises upper and lower segments, one of the segments of each of the stanchions being telescopically received in the other of the segments of the stanchion to permit selective lengthening and shortening of the length of the stanchion such that the height of the upper frame portion above a surface on which the stanchion rests may be adjusted to adapt to the leg length of the baby;

wherein the pair of stanchions located adjacent one of the end bars extend downwardly and outwardly with respect to the upper frame portion to resist tipping of the stationary frame as the baby seat support assembly moves toward the end bar; and wherein the stationary frame is comprised of a pair of opposed frame sections, and wherein the upper frame portion of each frame section comprises a generally U-shaped structure oriented in opposition to the U-shaped structure of the other frame section, wherein each U-shaped structure comprises one of said end bars and a portion of each side bar, wherein a central extent of the side bar of one of the U-shaped structures is adapted to be telescopically received in a central extent of the side bar portions of the other of the U-shaped structures to permit selective adjustment of the distance between the end bars of the upper frame portion such that the travel distance of the baby seat support assembly is selectively adjustable.

3. A stationary baby walker comprising:

a stationary frame including a rectangular upper frame portion formed of a pair of parallel side bars and a pair of parallel end bars, the frame further including four stanchions, each stanchion having an upper end coupled to an end of one of the side bars of the upper frame portion;

a baby seat support assembly including a support plate having a circular aperture formed therein and means for permitting said seat support assembly to move linearly between said end bars of said upper frame portion; and a baby seat having a side wall and a bottom wall, the bottom wall having a pair of leg apertures formed therein, wherein the baby seat defines an interior space and has an upper peripheral edge mounted to a circular upper peripheral lip extending radially outward from the side wall, the upper peripheral lip being rotatably rested on a top surface of the support plate with the side wall and bottom wall depending through the aperture of the support plate such that a baby seated in the baby seat is permitted to rotate the seat with respect to the support plate and the stationary frame;

wherein each of the stanchions comprises upper and lower segments, one of the segments of each of the stanchions being telescopically received in the other of the segments of the stanchion to permit selective lengthening and shortening of the length of the stanchion such that the height of the upper frame portion above a surface on which the stanchion rests may be adjusted to adapt to the leg length of the baby; and wherein the stationary frame is comprised of a pair of opposed frame sections, and wherein the tipper frame portion of each frame section comprises a generally U-shaped structure oriented in opposition to the U-shaped structure of the other frame section, wherein each U-shaped structure comprises one of said end bars and a portion of each side bar, wherein a central extent of the side bar portions of one of the U-shaped structures is adapted to be telescopically received in a central extent of the side bar portions of the other of the U-shaped structures to permit selective adjustment of the distance between the end bars of the tipper frame portion such that the travel distance of the baby seat support assembly is selectively adjustable.

4. The stationary baby walker of claim 3 wherein the side bars of the upper frame portion each have a hollow interior channel therein and a slot through a side wall of the side bar, wherein the baby seat support assembly includes a pair of L-shaped arms coupled to a lower surface of the support plate adjacent to each side edge of the support plate, each arm having a horizontal extent with a roller rotatably mounted to an end of the arm located opposite the support plate thereon, wherein each roller is rotatably situated in the hollow interior channel of one of the side bars of the upper frame portion such that the support plate is capable of moving between the end bars of the upper frame portion.

5. The stationary baby walker of claim 3 additionally comprising a support bar extending between central locations on the lower sections of adjacent stanchions in parallel with one of the side bars of the upper frame portion.

6. The stationary baby walker of claim 3 wherein the pair of stanchions located adjacent one of the end bars extend downwardly and outwardly with respect to the upper frame portion to resist tipping of the stationary frame as the baby seat support assembly moves toward the end bar.

* * * * *